US011333008B2

(12) United States Patent
Frosell et al.

(10) Patent No.: US 11,333,008 B2
(45) Date of Patent: May 17, 2022

(54) SYSTEMS AND METHODS FOR GRAVEL PACKING WELLS

(71) Applicant: Halliburton Energy Services, Inc., Houston, TX (US)

(72) Inventors: Thomas Jules Frosell, Dallas, TX (US); Maxime PM Coffin, Frisco, TX (US); Man Yee Leong, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 347 days.

(21) Appl. No.: 16/279,769

(22) Filed: Feb. 19, 2019

(65) Prior Publication Data

US 2019/0284913 A1 Sep. 19, 2019

Related U.S. Application Data

(63) Continuation of application No. PCT/US2019/018577, filed on Feb. 19, 2019.
(Continued)

(51) Int. Cl.
*E21B 43/04* (2006.01)
*E21B 43/08* (2006.01)
*E21B 43/10* (2006.01)

(52) U.S. Cl.
CPC ..... *E21B 43/045* (2013.01); *E21B 43/082* (2013.01); *E21B 43/084* (2013.01);
(Continued)

(58) Field of Classification Search
CPC .... E21B 43/045; E21B 43/082; E21B 43/084; E21B 43/086; E21B 43/088; E21B 43/103
See application file for complete search history.

(56) References Cited

U.S. PATENT DOCUMENTS 4,945,991 A 8/1990 Jones
5,082,052 A 1/1992 Jones et al.
(Continued)

FOREIGN PATENT DOCUMENTS

AU 731041 B2 3/2001
AU 2016225925 A1 9/2016
WO 2014065962 A1 5/2014

OTHER PUBLICATIONS

"Alternate Path Technology: Higher Prodction from Gravel-Packed Wells", Schlumberger, May 2001, 8 pages.
(Continued)

*Primary Examiner* — Christopher J Sebesta
(74) *Attorney, Agent, or Firm* — Conley Rose, P.C.; Rodney B. Carroll

(57) ABSTRACT

A well screen system includes upstream and downstream screen assemblies arranged along an axis. The assemblies each have first and second transport tubes. A first packing tube is connected to the first transport tube by first adapter and has an uppermost nozzle axially spaced from the first adapter by a first effective packing tube length. A second packing tube is connected to the second transport tube by a second adapter and has an uppermost nozzle axially spaced from the second adapter by a second effective packing tube length different than the first effective packing tube length. The downstream screen assembly second transport tube is connected to the upstream screen assembly first transport tube to alternate the effective packing tube lengths of packing tube uppermost nozzles along the screen system. Methods of making well screen systems and methods of gravel packing well screen systems are also disclosed.

20 Claims, 5 Drawing Sheets

Related U.S. Application Data

(60) Provisional application No. 62/644,975, filed on Mar. 19, 2018.

(52) U.S. Cl.
CPC ..... *E21B 43/086* (2013.01); *E21B 43/088* (2013.01); *E21B 43/103* (2013.01)

(56) References Cited

U.S. PATENT DOCUMENTS 5,113,935 A * 5/1992 Jones ..... E21B 43/08 166/51
5,417,284 A 5/1995 Jones
5,419,394 A 5/1995 Jones
8,833,445 B2 9/2014 Techentien et al.
8,960,287 B2 2/2015 Holderman et al.
9,759,046 B2 9/2017 Sanders
2002/0174984 A1* 11/2002 Jones ..... E21B 43/04 166/278
2005/0061501 A1 3/2005 Ward et al.
2008/0142227 A1* 6/2008 Yeh ..... E21B 43/04 166/369
2010/0139919 A1 6/2010 Yeh et al.
2010/0155064 A1* 6/2010 Nutley ..... E21B 33/1208 166/278
2012/0168159 A1* 7/2012 Edwards ..... E21B 43/04 166/278
2014/0027115 A1 1/2014 Sanders
2015/0218915 A1 8/2015 Langlais
2017/0022789 A1 1/2017 Hodge et al.

OTHER PUBLICATIONS

PCT International Search Report and Written Opinion issued for PCT application No. PCT/US2019/018577 dated Jun. 3, 2019, 11 pages.

* cited by examiner

SYSTEMS AND METHODS FOR GRAVEL PACKING WELLS

CROSS REFERENCE TO RELATED APPLICATIONS

This application claims the benefit of priority to U.S. Provisional Application No. 62/644,975, filed Mar. 19, 2018 and entitled "SYSTEMS AND METHODS FOR GRAVEL PACKING WELLS." This application is also a continuation of International Application No. PCT/US19/18577, filed Feb. 19, 2019 and entitled "SYSTEMS AND METHODS FOR GRAVEL PACKING WELLS," which claims the benefit of priority to U.S. Provisional Application No. 62/644,975, filed Mar. 19, 2018 and entitled "SYSTEMS AND METHODS FOR GRAVEL PACKING WELLS," the entire contents of which are hereby incorporated by reference herein.

BACKGROUND OF THE INVENTION

1. Field of the Invention

The present disclosure relates to well screen systems, and more particularly to well screen systems having packing tubes with alternating top nozzle locations for gravel packing wellbores.

2. Description of Related Art

Wells often use screening to control sand production by filtering sand from the fluid produced by the formation. Filtering is generally accomplished by gravel packing the annulus extending about the screening. For example, in open-hole completions, gravel can be placed between the wall of the wellbore and the screening. In a cased-hole completions, gravel can be placed between the screening and a perforated casing. In both types of completions the gravel pack allows for the production of fluids from the wellbore while limiting fines production.

The gravel pack material generally conveyed into the well and emplaced at the screening using a carrier fluid. Premature loss of the carrier fluid into the formation via leak-off can allow sand bridges to form in the annulus about the screening, causing incomplete packing and reducing the filtering efficiency of the gravel pack. In some wells shunt tubes are employed to provide paths around sand bridges, increasing the length of the screening gravel packed. The screening interval that can be gravel packed using shunt tubes is typically limited by the amount of leak-off in the well, the severity of leak-off increasing with increase in carrier fluid pressures.

Such conventional methods and systems have generally been considered satisfactory for their intended purpose. However, there is still a need in the art for improved well screen systems, methods of making well screen systems, and methods of gravel packing well screen systems due to increasing need to operate in higher pressure and extreme length applications. The present disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE PREFERRED EMBODIMENTS

Figure 1:
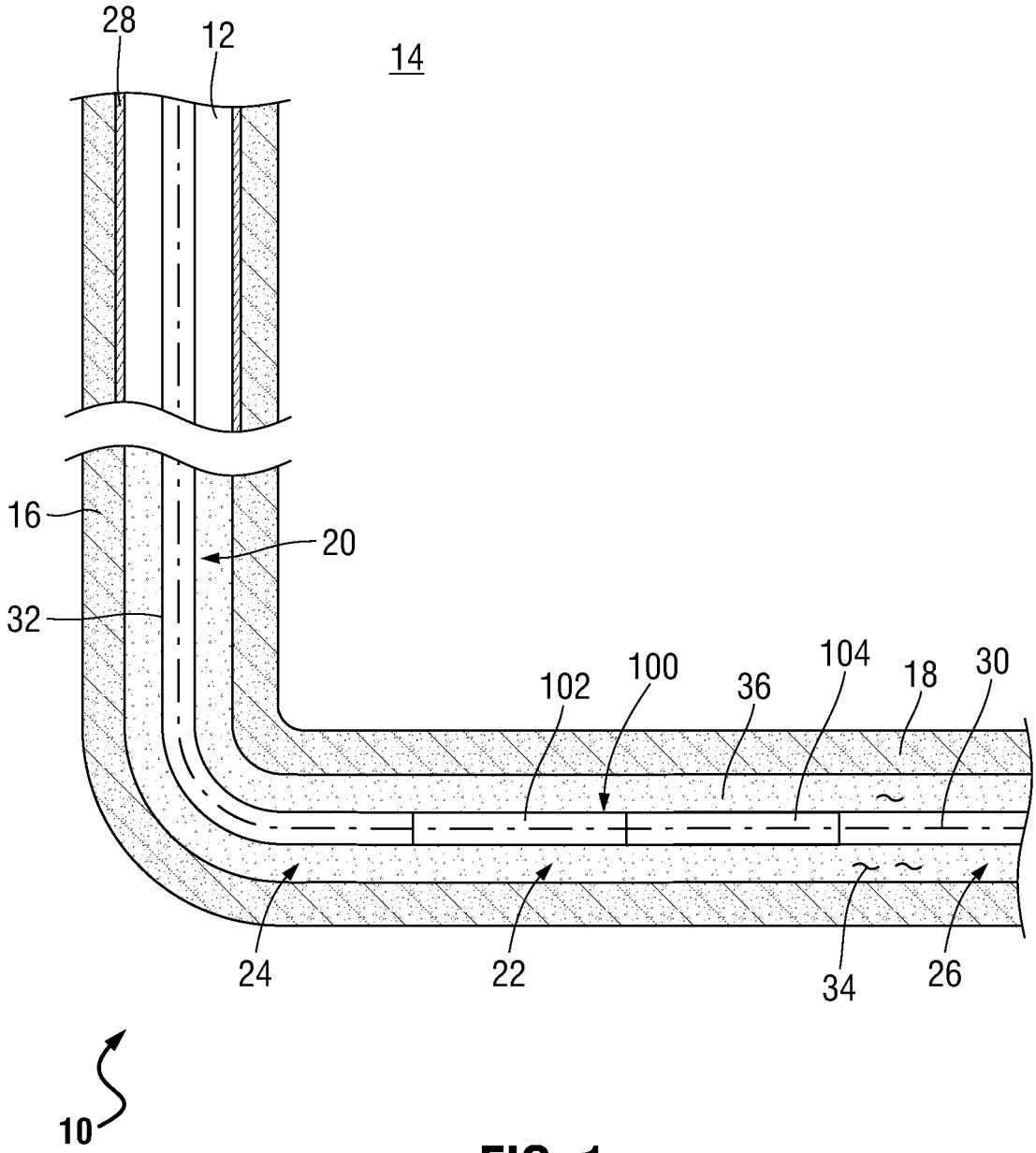
FIG. 1 is a schematic illustration of a well screen system constructed in accordance with the present disclosure, showing screen assemblies of the well screen system arranged within a wellbore.

Reference will now be made to the drawings wherein like reference numerals identify similar structural features or aspects of the subject disclosure. For purposes of explanation and illustration, and not limitation, a partial view of an exemplary embodiment of a well screen system in accordance with the disclosure is shown in FIG. 1 and is designated generally by reference character 100. Other embodiments of well screen systems, methods of making well screen systems, and methods of gravel packing well screen system in accordance with the disclosure, or aspects thereof, are provided in FIGS. 2-5, as will be described. The systems and methods described herein can be used for gravel packing well screen systems in wellbores for water, oil and gas extraction, such as to prevent sand from entering production tubes in horizontal wells, though the present disclosure is not limited to horizontal wells or to well screen systems for sand screening in general.

With the increased frequency of the operation of long interval, deviated, highly deviated, or horizontal wells, systems and assemblies to provide for a complete gravel pack are desired. As used herein, the terms "deviated well" or "highly deviated well" refer to a well or a section of a well that is deviated from a vertical orientation. As used herein, the terms "horizontal well" or "horizontal section of a well" refer to a well or section of a well that is deviated from a vertical orientation in a generally horizontal orientation at an angle from about 60 degrees to about 90 degrees relative to the ground surface. Some embodiments described herein refer to systems, assemblies, or devices that can be utilized in a horizontal well or a horizontal section of well or other wellbores employing screens, although not specifically stated, some of the same such embodiments may be utilized in a deviated or highly deviated well or well section.

In the following description of the representative embodiments, directional terms, such as "above", "below", "upper", "lower", "upstream", "downstream", etc. are used for convenience in referring to the accompanying drawings. In general, "above", "upper", "upstream", and similar terms refer to a direction toward the earth's surface along a well bore and "below", "lower", "downstream" and similar terms refer to a direction away from the earth's surface along the wellbore.

Well systems often utilize screens to control the ingress of material from the wellbore environment during production of fluids from the formation. Some of such well systems additionally utilize a gravel pack placed around or about the screens to control ingress, such as relatively fine materials like sand. Typically, gravel packing operations involve pumping slurry into an annulus between a completion string and a wellbore. In some embodiments, a well screen can be positioned about the completion string. The resulting gravel pack can be installed about the well screen connected to the completion string.

Multiple techniques and procedures for gravel packing are used in gravel packing operations. Some methods employ different carrier fluids having different viscosities to transport the gravel, for example using a viscous fluid, such as a gel, versus a low-viscosity fluid, such as water. Other methods pump the slurry at different velocities into the systems. Yet other methods utilize an alternate path screens or shunt tubes in the gravel packing operation.

In some methods, slurry can be pumped down a well system having a screen shunt tube configuration. The shunt tube configuration can provide an open path continuously along the length of a screen. As the slurry passes through the shunt tubes and reaches a point at which the system is not gravel packed, the slurry exits the shunt tubes and forces its way into the incompletely packed volume to further pack the system. In some embodiments, the shunt tubes can provide a complete pack around a screen by pumping a slurry down the shunt tubes to fill in any voids.

In some well systems shunt tubes can be employed to provide alternate flow paths for proppant/slurry mixtures to be diverted to the annular voids and continue gravel packing by bypassing blockages that otherwise impede the gravel packing process, such as premature sand bridges, by using packing tubes connected along the length of transport tubes. The shunt tube system, or other alternative-path screen systems, can provide an alternative route for fluid to flow resulting in a more complete gravel pack about the well screen. Such shunt tube systems include independent, alternate paths, each of which have one or more transport tube and one or more packing tube. The transport tube transports slurry along the completion, from top to bottom. The packing tube received slurry from the transport tube and distributes the slurry to nozzles about the completion to form the gravel pack.

Due to the prolonged shunt diversion and higher pressure in extreme length applications, leak-off through a packed packing tube may be excessive and could prematurely end the gravel packing process due to increase in gravel pack concentration that would bridge the transport tube. In embodiments described herein well screen systems are employed having well screen assemblies with axially alternating uppermost nozzle locations on the packing tubes in the shunt system. The axially alternating uppermost nozzle locations reduce leak-off along a wellbore or completion as the average length of the nozzle placement is increased, thereby reducing the leak-off rate.

In some embodiments, the shunt tube system can have exit or output nozzles positioned along the length the well screen. The shunt tube system can feed gravel slurry to the nozzles. The nozzles can be positioned a certain distance apart. In some embodiments, the nozzles may be about 1 to about 2 meters apart. In other embodiments, the nozzles can be positioned at a distance apart to provide sufficient gravel placement over a length of the system.

Referring to FIG. 1, a well system 10 is shown. Well system 10 includes a wellbore 12. Wellbore 12 extends from surface 14 through earth strata 16 and into a subterranean formation 18. Subterranean formation 18 includes production materials, such as water, oil and/or gas 34, and is accessed through wellbore 12 through a substantially vertical wellbore section 20 and a substantially horizontal wellbore section 22. Horizontal wellbore section 22 extends through as least a portion of subterranean formation 18 between a heel region 24 and a toe region 26, heel region 24 being upstream (relative to the flow of water/oil/gas from subterranean formation 18 moving from substantially horizontal wellbore section 22 to surface 14) of toe region 26.

Substantially vertical wellbore section 20 includes a casing string 28 cemented at an upper portion of the substantially vertical wellbore section 20. In some embodiments, a substantially vertical section may not have a casing string. The substantially horizontal wellbore section 22 is open hole and extends through hydrocarbon bearing subterranean formation 18 along a well axis 30. In some embodiments, a substantially horizontal section may have casing with perforated base pipe 106.

A completion string 32 extends from surface 14 within wellbore 12. Completion string 32 can provide a conduit for formation fluids to travel from substantially horizontal wellbore section 22 to surface 14 or for injection fluids to travel from surface 14 to subterranean formation 18 for injection wells. Substantially horizontal wellbore section 22 comprises a well screen system 100 having at least an upstream screen assembly 102 and an axially adjacent downstream screen assembly 104. The upstream screen assembly 102 and the downstream screen assembly 104 are interconnected to completion string 32. A gravel pack 36 is installed about well screen system 100 as well as a portion of the wellbore 12.

In the illustrated exemplary well screen system 100 includes only two well screen assemblies. This is for illustration purpose only and is non-limiting as it should be appreciated that any number of screen assemblies can be employed in well screen system 100. Further, the distance between or relative position of each well screen assembly in well screen system 100 can be modified or adjusted to provide the desired production set up.

Figure 2:
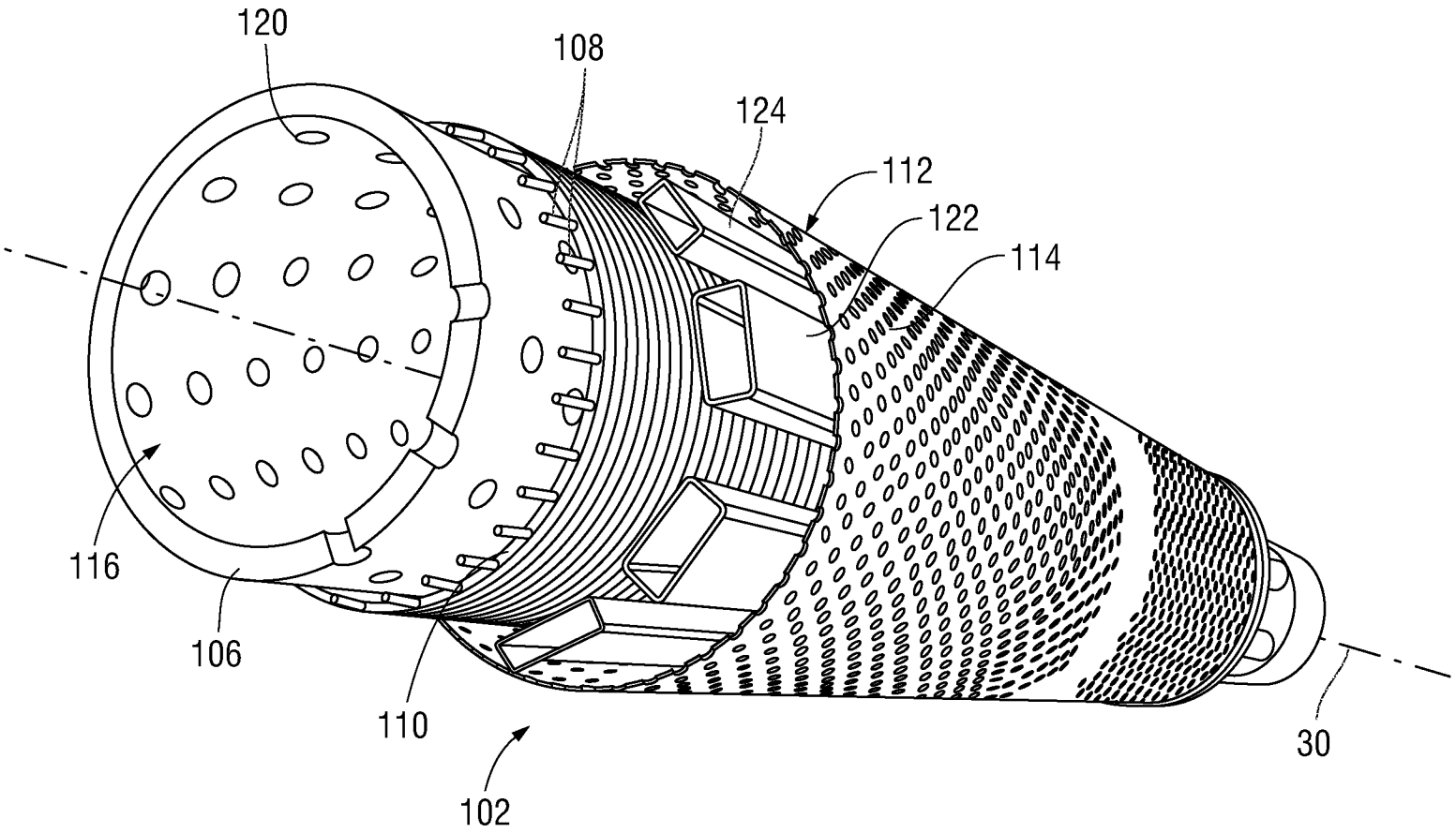
FIG. 2 is a perspective view of one of the screen assemblies of the well screen system of FIG. 1, showing a shunt system with transport tubes and packing tubes arranged within the screen assembly.

With reference to FIG. 2, a well screen assembly, e.g., upstream screen assembly 102 is shown. Upstream screen assembly 102 includes perforated base pipe 106, a filter media 108 including (but not necessarily be limited to) longitudinal ribs, rods, and/or mesh, wire 110, a shunt tube system 112 having one or more transport tubes 122 and one or more packing tubes 124, and in certain embodiments a perforated protective jacket or shroud structure 114. Perforated base pipe 106 is arranged along well axis 30, bounds an interior 116, forms a portion of the length of casing string 28, and has a plurality of perforations 120 extending through a wall of perforated base pipe 106. Filter media 108 is arranged along the axial length of perforated base pipe 106 to create an annular space extending about perforated base pipe 106 and radially between perforated base pipe 106 and wire 110. In the illustrated exemplary embodiment longitudinal filter media 108 extend substantially in parallel with well axis 30.

Wire 110 is wrapped about perforated base pipe 106 such that filter media 108 is arranged radially between wire 110 and perforated base pipe 106. Shunt tube system 112 is arranged radially outward of wire 110 and includes transport tube 122 and packing tube 124. Transport tube 122 extends longitudinally along perforated base pipe 106 and in the illustrated exemplary embodiment is substantially parallel to well axis 30. Packing tube 124 is connected to transport tube 122 such that the interior of packing tube 124 is in fluid communication with an interior of transport tube 122 to receive a portion of a proppant/slurry mixture flowing through transport tube 122. Perforated protective jacket or shroud structure 114, which in the illustrated exemplary embodiment is a perforated sheet member, extends about perforated base pipe 106. Shunt tube system 112 arranged radially between perforated base pipe 106 and perforated protective jacket or shroud structure 114.

Downstream screen assembly 104 (shown in FIG. 1) is similar to upstream screen assembly 102 and is additionally arranged such that a second transport tube 160 of downstream screen assembly 104 is connected to first transport tube 122 of upstream screen assembly 102. This alternates effective packing tube lengths 140/170 of packing tube uppermost nozzles 134/162 along well screen system 100, which reduces leak-off within extending the distance packed between upper screen assembly 102 and lower screen assembly 104 and provides a relatively compact system with relative low leak-off for effective gravel packing.

Figure 3:
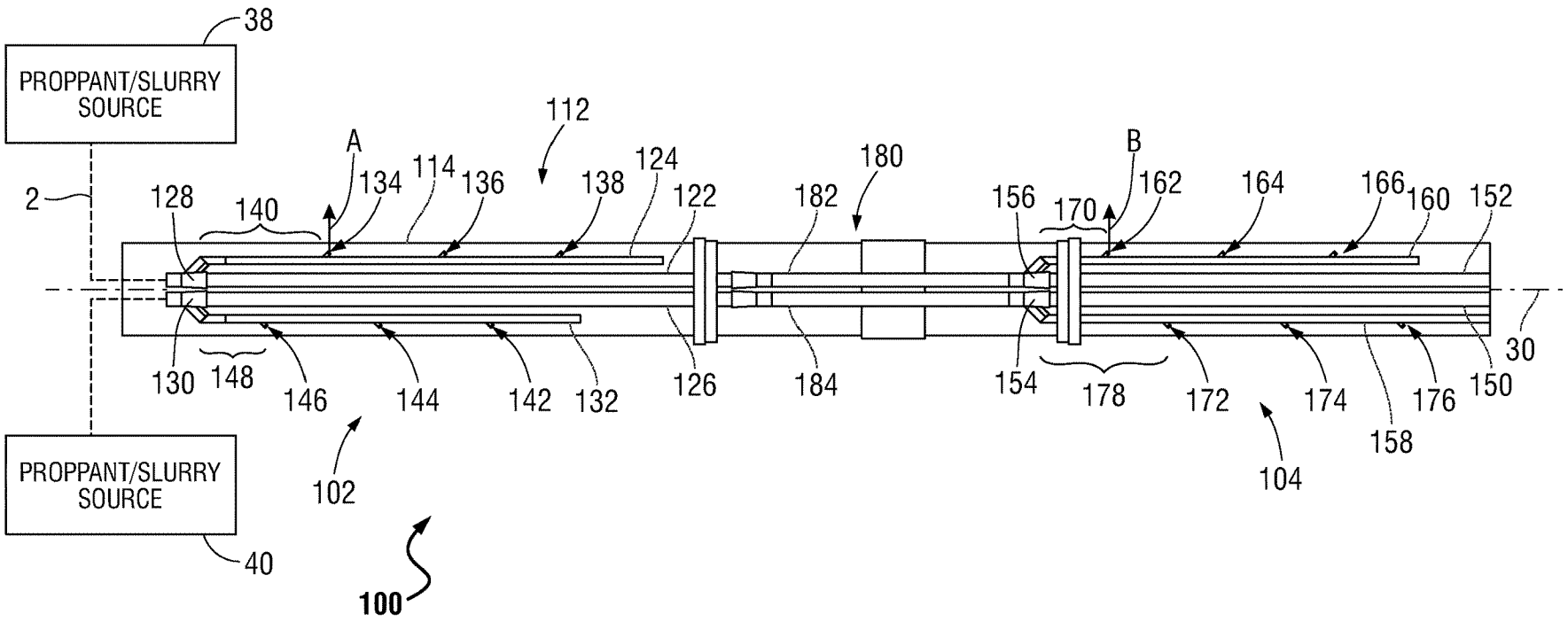
FIG. 3 is a top view of the well screen system of FIG. 1, showing positions of the packing tube uppermost nozzles along the upper screen assembly and the lower screen assembly of the well screen system.

With reference to FIG. 3, well screen system 100 is shown in a top view, e.g., from a location between surface 4 and well screen system 100 positioned in a horizontal wellbore. Shunt tube system 112 comprises the transport tubes, packing tubes, and adapters of upstream screen assembly 102 and downstream screen assembly 104. In this respect upstream screen assembly 102 includes first transport tube 122, a second transport tube 126, a first adapter 128, and a second adapter 130. Upstream screen assembly also includes a first packing tube 124 and a second packing tube 132.

First adapter 128 connects first packing tube 124 to first transport tube 122. First packing tube 124 includes an uppermost nozzle 134, an intermediate nozzle 136, and a lowermost nozzle 138. Uppermost nozzle 134 is axially separated from first adapter 128 by a first effective packing tube length 140, effective tube length as used herein meaning the length of a packing tube, which cooperates with the uppermost tube length of the axially adjacent well screen assembly to determine leak-off during gravel packing. Although first packing tube 124 is shown as having three nozzles in the illustrated exemplary embodiment, those of skill in the art will appreciate that well screen systems can have packing tubes with more than three nozzles, as suitable for an intended application.

Second adapter 130 connects second packing tube 132 to second transport tube 126. Second packing tube 132 includes an uppermost nozzle 146, an intermediate nozzle 144, and a lowermost nozzle 142. Uppermost nozzle 146 is axially offset from first packing tube uppermost nozzle 134 and is axially separated from second adapter 130 by a second effective packing tube length 148, second effective packing tube length 148 being less than first effective packing tube length 140. In the illustrated exemplary embodiment lowermost nozzle 142 of second packing tube 132 is arranged axially between first packing tube lowermost nozzle 138 and first packing tube intermediate nozzle 136, and first packing tube uppermost nozzle 134 is arranged axially between second packing tube uppermost nozzle 146 and second packing tube intermediate nozzle 144. As also shown in the illustrated exemplary embodiment, second packing tube 132 has an axial length that is less than the axial length of first packing tube 124.

Downstream screen assembly 104 is similar to upstream screen assembly 102 and is additionally connected to upstream screen assembly 102 such that second transport tube 152 of downstream screen assembly 104 is connected to first transport tube 122 of upstream screen assembly 122. This similarly alternates effective packing tube lengths 240/170 of packing tube uppermost nozzles 134/162 along the axial length of well screen system 100. As indicated in FIG. 3, downstream screen assembly 104 includes a downstream screen assembly first transport tube 150, a downstream screen assembly second transport tube 152, a downstream screen assembly first adapter 154, and a downstream screen assembly second adapter 156. Downstream screen assembly 104 also includes a downstream screen assembly first packing tube 158 and a downstream screen assembly second packing tube 160.

Downstream screen assembly second adapter 156 connects upstream screen assembly first transport tube 122 to downstream screen assembly second transport tube 152. Downstream screen assembly second adapter 156 also connects downstream screen assembly second packing tube 160 to downstream screen assembly second transport tube 152. Downstream screen assembly second packing tube 160 includes an uppermost nozzle 162, an intermediate nozzle 164, and a lowermost nozzle 166. Uppermost nozzle 162 is separated from downstream screen assembly second adapter 156 by an effective packing tube length 170, which is different (e.g., shorter in the illustrated exemplary embodiment) than upstream screen assembly first packing tube uppermost nozzle effective packing tube length 140. By alternating uppermost nozzle location on at least two axially adjacent screen assemblies, e.g., upstream screen assembly 102 and downstream screen assembly 104, average length between nozzles is increased, reducing leak-off, thereby extending the distance that gravel packing can occur along the length of wellbore 12 (shown in FIG. 1).

Downstream screen assembly first adapter 154 connects upstream screen assembly second transport tube 126 to downstream screen assembly first transport tube 150. Downstream screen assembly first adapter 154 also connects downstream screen assembly first packing tube 158 to upstream screen assembly second packing tube 126 and downstream screen assembly first transport tube 150. Downstream screen assembly first packing tube 158 includes an uppermost nozzle 172, an intermediate nozzle 174, and a lowermost nozzle 176. Uppermost nozzle 172 is separated from downstream screen assembly first adapter 154 an effective packing tube length 178, which is different (e.g., longer in the illustrated exemplary embodiment) than upstream screen assembly second packing tube uppermost nozzle effective packing tube length 148.

As also shown in FIG. 3, well screen system 100 includes a coupling 180, a first jumper tube 182, and a second jumper tube 184. Coupling 180 connect upstream screen assembly 102 to downstream screen assembly 104. First jumper tube 182 and second jumper tube 184 each extend along coupling 180 and between upstream screen assembly 102 and downstream screen assembly 104. First jumper tube 182 connects downstream screen assembly second transport tube 152 with upstream screen assembly first transport tube 122, and therethrough to a common proppant/slurry source 38. Connection with upstream screen assembly first transport tube 122 is through a sleeve. Connection with downstream screen assembly second transport tube 152 is through downstream screen assembly second adapter 156.

Second jumper tube 184 connects downstream screen assembly first transport tube 150 with upstream screen assembly second transport tube 126, and therethrough to a common proppant/slurry source 40. Connection with upstream screen assembly second transport tube 126 is through a sleeve. Connection with downstream screen assembly first transport tube 150 is through downstream screen assembly first adapter 154. This provides two sets of independent transport tubes in a 2×2 arrangement. It is contemplated that, in certain embodiments, more than two sets of independent transport tubes (and associated packing tubes) can be included in well screen system 100, as suitable for an intended application.

Figure 4:
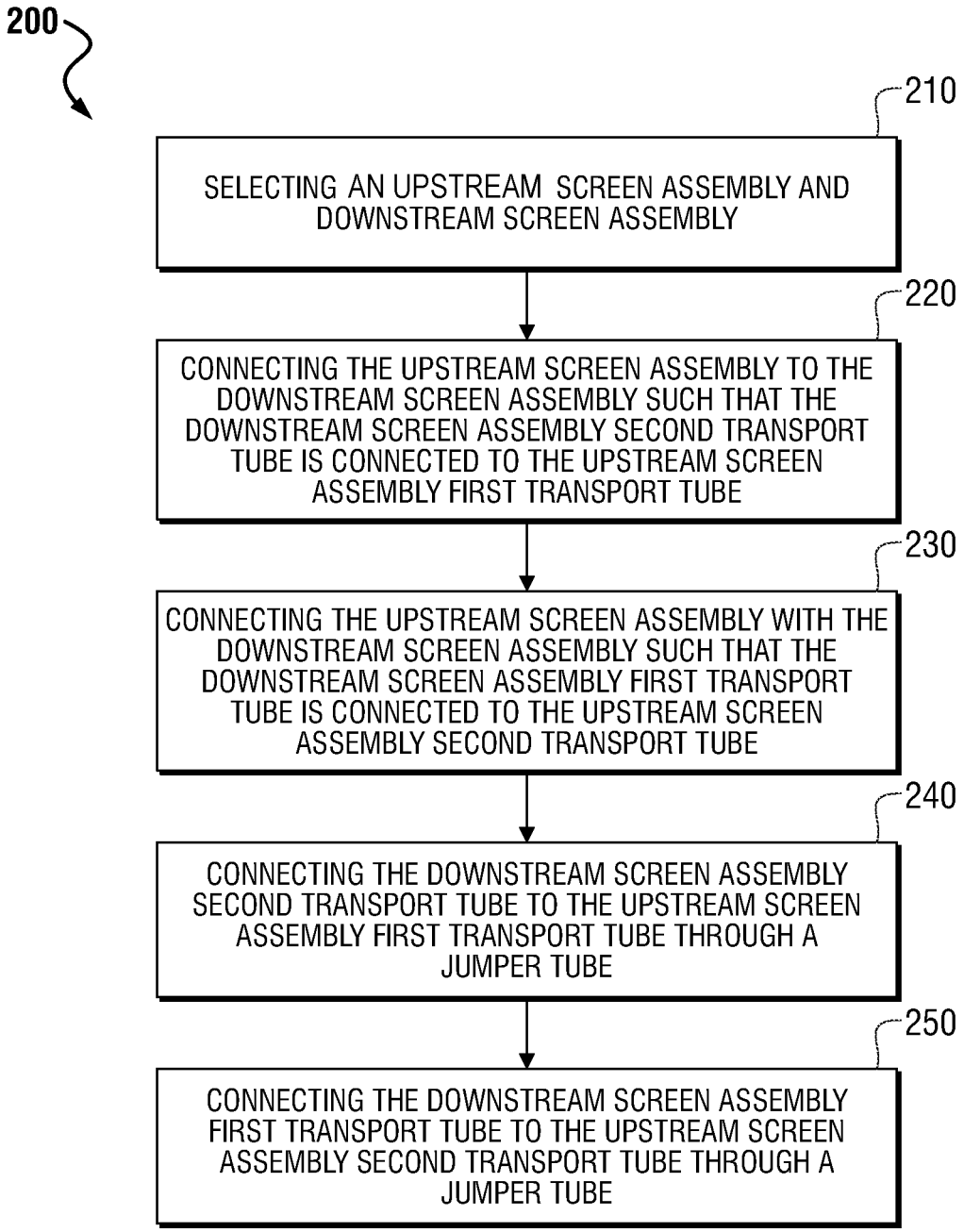
FIG. 4 is a block diagram of a method making a well screen system, showing steps of the method.

With reference to FIG. 4, a method 200 of making a well screen system, e.g., well screen system 100 (shown in FIG. 1), is shown. Method 200 includes selecting a downstream screen assembly and a downstream screen assembly, e.g., upstream screen assembly 102 (shown in FIG. 3) and downstream screen assembly 104 (shown in FIG. 3), as shown with box 210. The upstream and downstream screen assemblies each have first and second transport tubes, e.g., first transport tube 122 (shown in FIG. 3) and a second transport tube 126 (shown in FIG. 3), each supported within the screen assembly that extend axially along the respective screen assembly.

A first packing tube, e.g., first packing tube 124 (shown in FIG. 3) is connected to the first transport tube by a first adapter, e.g., first adapter 128 (shown in FIG. 3) and has an uppermost nozzle, e.g., uppermost nozzle 123 (shown in FIG. 3). The uppermost nozzle is axially spaced from the first adapter by a first effective packing tube length, e.g., first effective packing tube length 140 (shown in FIG. 3).

A second packing tube, e.g., second packing tube 132 (shown in FIG. 3), is connected to the second transport tube by a second adapter, e.g., second adapter 130 (shown in FIG. 3) and has an uppermost nozzle, e.g., uppermost nozzle 146 (shown in FIG. 3). The uppermost nozzle axially spaced from the second adapter by a second effective packing tube length, e.g., second effective packing tube length 148 (shown in FIG. 3), the second effective packing tube length being different than the first effective packing tube length. The upstream screen assembly is then connected to the downstream screen assembly such that the downstream screen assembly second transport tube is connected to the upstream screen assembly first transport tube, as shown with box 220.

Connecting the upstream screen assembly with the downstream screen assembly can include connecting the downstream screen assembly second transport tube to the upstream screen assembly first transport tube through a jumper tube, e.g., first jumper tube 182 (shown in FIG. 3), as shown with box 240. As will be appreciated by those of skill in the art in view of the present disclosure, connecting the downstream screen assembly second transport tube to the upstream screen assembly first transport tube can alternate the effective packing tube lengths of the uppermost nozzles along the length of the well screen system. The alternating effective packing tube lengths in turn reduces leak-off without extending the distance packed between the upstream screen assembly and the downstream screen assembly.

In certain embodiments connecting the upstream screen assembly to the downstream screen assembly can include connecting the screen assemblies such that the downstream screen assembly first transport tube is connected to the upstream screen assembly second transport tube, as shown with box 230. Connecting the upstream screen assembly with the downstream screen assembly can include connecting the downstream screen assembly first transport tube to the upstream screen assembly second transport tube through a separate jumper tube, e.g., second jumper tube 184 (shown in FIG. 3), as shown with box 250.

Figure 5:
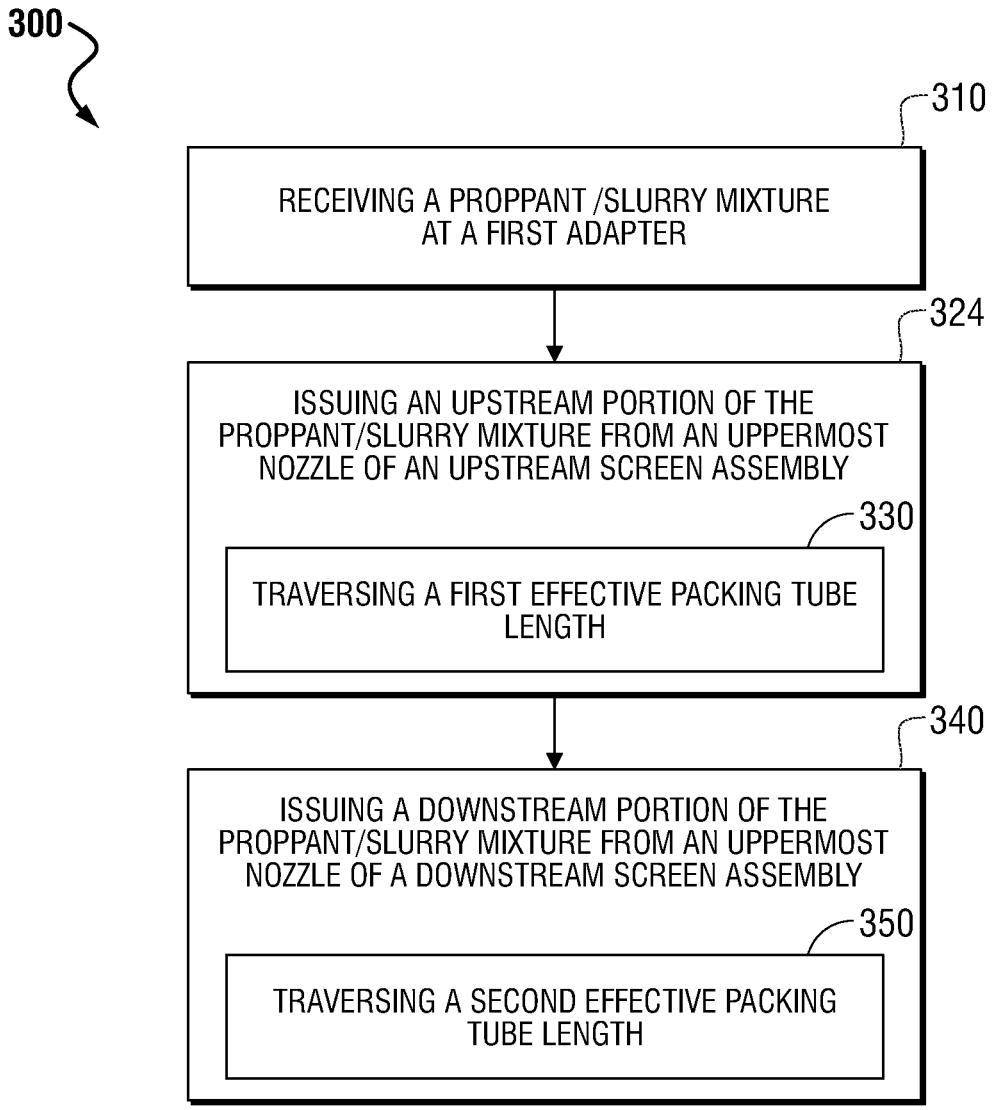
FIG. 5 is a block diagram of a method of gravel packing a well screen system, showing the steps of the method.

With reference to FIG. 5, a method 300 of gravel packing a screen system, e.g., well screen system 100 (shown in FIG. 1), is shown. Method 300 includes receiving a proppant/slurry mixture, e.g., a proppant/slurry mixture 2 (shown in FIG. 3), at a first adapter, e.g., upstream screen assembly first adapter 128 (shown in FIG. 3), as shown with box 310. An upstream portion of the proppant/slurry mixture, e.g., upstream proppant/slurry portion A (shown in FIG. 3), traverses a first effective packing tube length, e.g., upstream screen assembly first packing tube effective length 140 (shown in FIG. 3), as shown in box 330. The upstream proppant/slurry portion is issued in to the screen assembly and/or wellbore from an upstream first packing tube uppermost nozzle, e.g., uppermost nozzle 134 (shown in FIG. 3), as shown with box 320. A downstream portion of the proppant/slurry mixture, e.g., downstream proppant/slurry mixture portion B (shown in FIG. 3), traverses a downstream screen assembly second packing tube effective length, e.g., effective packing tube length 170 (shown in FIG. 3), and issues from a downstream screen assembly second packing tube uppermost nozzle, e.g., downstream screen assembly second packing tube uppermost nozzle 162 (shown in FIG. 3), as shown with boxes 340 and 350.

In an aspect of the present disclosure a well screen system includes upstream and downstream screen assemblies arranged along an axis. The assemblies have first and second transport tubes extending axially along the screen assembly. A first packing tube is connected to the first transport tube by first adapter with an uppermost nozzle axially spaced from the first adapter by a first effective packing tube length. A second packing tube is connected to the second transport tube by a second adapter with an uppermost nozzle axially spaced from the second adapter by a second effective packing tube length, the second effective packing tube length being different (e.g., shorter) than the first effective packing tube length. The downstream screen assembly second transport tube is connected to upstream screen assembly first transport tube to alternate the effective packing tube lengths of packing tube uppermost nozzles along the screen system.

In certain embodiment the upstream screen assembly first packing tube can be longer than the downstream screen assembly second packing tube, and/or the upstream screen assembly second packing tube can be shorter than the downstream screen assembly first packing tube. The downstream screen assembly second adapter can be connected to the upstream screen assembly first transport tube, and/or the downstream screen assembly first adapter can be connected to the upstream screen assembly second transport tube. The downstream screen assembly first packing tube can be connected to the upstream screen assembly second transport tube through the downstream screen assembly second adapter and a jumper tube, and/or the downstream screen assembly second packing tube can be connected to the upstream screen assembly first transport tube through the downstream screen assembly first adapter and a jumper tube.

In accordance with certain embodiments, the upstream screen assembly first packing tube can have an intermediate nozzle axially adjacent to the uppermost nozzle and upstream screen assembly second packing tube can have an intermediate nozzle axially adjacent to the uppermost nozzle. The intermediate nozzle of the upstream screen assembly first packing tube can be located axially between the uppermost and intermediate nozzles of the upstream screen assembly second packing tube. It is contemplated that the downstream screen assembly first packing tube can have an intermediate nozzle axially adjacent to the uppermost nozzle and that the downstream screen assembly second packing tube can have an intermediate nozzle axially adjacent to the uppermost nozzle. The intermediate nozzle of the downstream screen assembly second packing tube can be located axially between the uppermost and intermediate nozzles of the downstream screen assembly first packing tube.

It is also contemplated that, in accordance with certain embodiments, the upstream screen assembly first packing tube can have a lowermost nozzle and the upstream screen assembly second packing tube can have a lowermost nozzle. The lowermost nozzle of the second packing tube can be located axially between the uppermost and lowermost nozzles of the upstream screen assembly first packing tube. The downstream screen assembly first packing tube can have a lowermost nozzle and the downstream screen assembly second packing tube can have a lowermost nozzle. The second packing tube lowermost nozzle of the second packing tube can be located axially between the uppermost and lowermost nozzles of the downstream screen assembly first packing tube.

In certain embodiments a coupling can be located axially between the upstream screen assembly and the downstream screen assembly. The coupling can connect the downstream screen assembly with the upstream screen assembly. The first transport tube can include a jumper tube arranged within the coupling. The second transport tube can include a jumper tube arranged within the coupling. The upstream screen assembly first transport tube can be connected by a first jumper tube extending along the coupling to the downstream screen assembly second transport tube, and/or the upstream screen assembly second transport tube can be connected by a second jumper tube extending along the coupling to the downstream screen assembly first transport tube. A proppant/slurry source can be connected to the upper screen assembly first transport tube and/or second transport tube.

In another aspect a method of making a well screen system includes selecting an upstream screen assembly and a downstream screen assembly. The upstream and downstream screen assemblies each have first and second transport tubes supported within the screen assembly that extend axially along the respective screen assembly. A first packing tube is connected to the first transport tube by a first adapter and has an uppermost nozzle. The uppermost nozzle of the first packing tube is axially spaced from the first adapter by a first effective packing tube length. A second packing tube is connected to the second transport tube by a second adapter and has an uppermost nozzle. The uppermost nozzle of the second packing tube is axially spaced from the second adapter by a second effective packing tube length. The second effective packing tube length is different than the first effective packing tube length. The upstream screen assembly is connected to the downstream screen assembly such that the downstream screen assembly second transport tube is connected to the upstream screen assembly first transport tube.

In certain embodiments the method can include connecting the upstream screen assembly with the downstream screen assembly such that the downstream screen assembly first transport tube is connected to the upstream screen assembly second transport tube. Connecting the upstream screen assembly with the downstream screen assembly can include connecting the downstream screen assembly second transport tube to the upstream screen assembly first transport tube through a jumper tube.

In a further aspect a method of gravel packing a scan screen system includes, at a well screen system as described above, a proppant/slurry mixture is received at the upstream screen assembly first adapter. An upstream portion of the proppant/slurry mixture is issued into the wellbore from the uppermost nozzle of the upstream screen assembly first packing tube, the upstream portion of the proppant/slurry mixture traversing the first effective packing tube length. A downstream portion of the proppant/slurry mixture is issued into the wellbore from the uppermost nozzle of the downstream screen assembly second packing tube, the downstream portion of the proppant/slurry mixture traversing the second effective packing tube length.

The illustrative examples are given to introduce the reader to the general subject matter discussed herein and not intended to limit the scope of the disclosed concepts. The above description describes various additional embodiments and examples with reference to the drawings in which like numerals indicate like elements and directional description are used to describe illustrative embodiments but, like the illustrative embodiments, should not be used to limit the present disclosure.

The methods and systems of the present disclosure, as described above and shown in the drawings, provide well screen systems, methods of making well screen systems, and methods of gravel packing well screen systems with superior properties including alternating effective packing tube lengths between uppermost nozzle on axially adjacent screen assemblies to reduce leak-off without extending the distance packed between the adjacent screen assemblies. In certain embodiments the present disclosure provides a relatively compact well screen system with relatively low leak-off relative to the wellbore length gravel packed by the well screen system. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A well screen system, comprising:

an upstream screen assembly and a downstream screen assembly arranged along an axis, the upstream screen assembly and the downstream screen assembly both having:

a first transport tube and a second transport tube extending axially along the screen assembly;

a first packing tube connected to the first transport tube by a first adapter and having an uppermost nozzle, the uppermost nozzle axially spaced from the first adapter by a first effective packing tube length; and a second packing tube connected to the second transport tube by a second adapter and having an uppermost nozzle, the uppermost nozzle axially spaced from the second adapter by a second effective packing tube length, the second effective packing tube length different than the first effective packing tube length, wherein the second transport tube of the downstream screen assembly is connected to and in fluid communication with the first transport tube of the upstream screen assembly to alternate effective packing tube lengths of packing tube uppermost nozzles connected to one another along the well screen system;

wherein the difference between the first and second effective packing tube lengths reduces leak-off of carrier fluid; and wherein the downstream screen assembly second packing tube is connected to the upstream screen assembly first transport tube by the downstream screen assembly second adapter and a jumper tube.

2. The well screen system as recited in claim 1, wherein the upstream screen assembly first packing tube first effective packing tube length is greater than the downstream screen assembly second packing tube second effective packing tube length.

3. The well screen system as recited in claim 1, wherein the upstream screen assembly second packing tube second effective packing tube length is less than the downstream screen assembly first packing tube first effective packing tube length.

4. The well screen system as recited in claim 1, wherein the downstream screen assembly first packing tube is connected to the upstream screen assembly second transport tube through the downstream screen assembly first adapter and a jumper tube.

5. The well screen system as recited in claim 1, wherein the downstream screen assembly first adapter is connected to the upstream screen assembly second transport tube.

6. The well screen system as recited in claim 1, wherein the upstream screen assembly first packing tube has an intermediate nozzle axially adjacent to the uppermost nozzle, wherein the upstream screen assembly second packing tube has an intermediate nozzle axially adjacent to the uppermost nozzle, and wherein the intermediate nozzle of the second packing tube is located axially between the uppermost and intermediate nozzles of the upstream screen assembly first packing tube.

7. The well screen system as recited in claim 1, wherein the downstream screen assembly first packing tube has an intermediate nozzle axially adjacent to the uppermost nozzle, wherein the downstream screen assembly second packing tube has an intermediate nozzle axially adjacent to the uppermost nozzle, and wherein the intermediate nozzle of the second packing tube is located axially between the uppermost and intermediate nozzles of the downstream screen assembly first packing tube.

8. The well screen system as recited in claim 1, wherein the upstream screen assembly first packing tube has a lowermost nozzle, wherein the upstream screen assembly second packing tube has a lowermost nozzle, and wherein the lowermost nozzle of the second packing tube is located axially between the uppermost and lowermost nozzles of the upstream screen assembly first packing tube.

9. The well screen system as recited in claim 1, wherein the downstream screen assembly first packing tube has a lowermost nozzle, wherein the downstream screen assembly second packing tube has a lowermost nozzle, and wherein the lowermost nozzle of the second packing tube is located axially between the uppermost and lowermost nozzles of the downstream screen assembly first packing tube.

10. The well screen system as recited in claim 1, further comprising a coupling located axially between the upstream screen assembly and the downstream screen assembly, the coupling connecting the downstream screen assembly to the upstream screen assembly.

11. The well screen system as recited in claim 1, further comprising a proppant/slurry source connected to at least one of the upper screen assembly first transport tube, the upper screen assembly second transport tube, or both.

12. A method of making a well screen system, comprising:

selecting an upstream screen assembly and a downstream screen assembly, the upstream and downstream screen assemblies each having:

first and second transport tubes supported within the screen assembly extending axially along the screen assembly, a first packing tube connected to the first transport tube by a first adapter and having an uppermost nozzle, the uppermost nozzle axially spaced from the first adapter by a first effective packing tube length, and a second packing tube connected to the second transport tube by a second adapter and having an uppermost nozzle, the uppermost nozzle axially spaced from the second adapter by a second effective packing tube length, the second effective packing tube length being different than the first effective packing tube length;

connecting the upstream screen assembly to the downstream screen assembly such that the downstream screen assembly second transport tube is connected to and in fluid communication with the upstream screen assembly first transport tube;

wherein the difference between the first and second effective packing tube lengths reduces leak off of carrier fluid; and wherein connecting the upstream screen assembly with the downstream screen assembly further comprises connecting the downstream screen assembly second transport tube to the upstream screen assembly first transport tube through a jumper tube.

13. The method as recited in claim 12, wherein connecting the upstream screen assembly with the downstream screen assembly is such that the downstream screen assembly first transport tube is connected to the upstream screen assembly second transport tube.

14. A well screen system, comprising:

an upstream screen assembly and a downstream screen assembly arranged along an axis, the upstream screen assembly and the downstream screen assembly both having:

a first transport tube and a second transport tube extending axially along the screen assembly;

a first packing tube connected to the first transport tube by a first adapter and having an uppermost nozzle, the uppermost nozzle axially spaced from the first adapter by a first effective packing tube length; and a second packing tube connected to the second transport tube by a second adapter and having an uppermost nozzle, the uppermost nozzle axially spaced from the second adapter by a second effective packing tube length, the second effective packing tube length different than the first effective packing tube length, wherein the second transport tube of the downstream screen assembly is connected to and in fluid communication with the first transport tube of the upstream screen assembly to alternate effective packing tube lengths of packing tube uppermost nozzles connected to one another along the well screen system;

wherein the difference between the first and second effective packing tube lengths reduces leak-off of carrier fluid; and wherein the downstream screen assembly first packing tube is connected to the upstream screen assembly second transport tube through the downstream screen assembly first adapter and a jumper tube.

15. The well screen system as recited in claim 14, wherein the downstream screen assembly second adapter is connected to the upstream screen assembly first transport tube.

16. The well screen system as recited in claim 14, further comprising a coupling located axially between the upstream screen assembly and the downstream screen assembly, the coupling connecting the downstream screen assembly to the upstream screen assembly.

17. The well screen system as recited in claim 16, wherein the upstream screen assembly second transport tube is connected by a second jumper tube extending along the coupling to the downstream screen assembly first transport tube.

18. A well screen system, comprising:

an upstream screen assembly and a downstream screen assembly arranged along an axis, the upstream screen assembly and the downstream screen assembly both having:

a first transport tube and a second transport tube extending axially along the screen assembly;

a first packing tube connected to the first transport tube by a first adapter and having an uppermost nozzle, the uppermost nozzle axially spaced from the first adapter by a first effective packing tube length; and a second packing tube connected to the second transport tube by a second adapter and having an uppermost nozzle, the uppermost nozzle axially spaced from the second adapter by a second effective packing tube length, the second effective packing tube length different than the first effective packing tube length, a coupling located axially between the upstream screen assembly and the downstream screen assembly, the coupling connecting the downstream screen assembly to the upstream screen assembly;

wherein the second transport tube of the downstream screen assembly is connected to and in fluid communication with the first transport tube of the upstream screen assembly to alternate effective packing tube lengths of packing tube uppermost nozzles connected to one another along the well screen system;

wherein the difference between the first and second effective packing tube lengths reduces leak-off of carrier fluid;

at least one jumper tube extending along the coupling between the upstream screen assembly and the downstream screen assembly; wherein i) a first jumper tube connects the first transport tube of the upstream screen assembly and the second transport tube of the downstream screen assembly, ii) a second jumper tube connects the second transport tube of the upstream screen assembly and the first transport tube of the downstream assembly, or iii) both.

19. The well screen system as recited in claim 18, wherein the downstream screen assembly second packing tube is connected to the upstream screen assembly first transport tube by the downstream screen assembly second adapter and a jumper tube.

20. The well screen system as recited in claim 18, wherein the downstream screen assembly first packing tube is connected to the upstream screen assembly second transport tube through the downstream screen assembly first adapter and a jumper tube.

* * * * *